US005246144A

United States Patent [19]

Cathcart, Sr. et al.

[11] Patent Number: 5,246,144

[45] Date of Patent: * Sep. 21, 1993

[54] AUTOMATIC TUCKPOINTING GUN

[76] Inventors: John C. Cathcart, Sr., Rte. #1, Box 46, Marissa, Ill. 62257; John A. Coke, Jr., General Delivery, Coulterville, Ill. 62237

[ * ] Notice: The portion of the term of this patent subsequent to Sep. 10, 2008 has been disclaimed.

[21] Appl. No.: 726,762

[22] Filed: Jul. 8, 1991

Related U.S. Application Data

[63] Continuation-in-part of Ser. No. 457,143, Dec. 26, 1989, Pat. No. 5,046,642.

[51] Int. Cl.[5] ..... B67D 5/42

[52] U.S. Cl. ..... 222/153; 222/326; 222/391

[58] Field of Search ..... 222/323, 325, 327, 333, 222/336, 389, 391, 153

[56] References Cited

U.S. PATENT DOCUMENTS

| | | | |
|---|---|---|---|
| 2,617,560 | 11/1952 | Pietrzak | 222/340 |
| 2,692,706 | 10/1954 | Wiksten | 222/326 |
| 2,694,508 | 11/1954 | Petrenchak | 222/323 |
| 2,838,210 | 6/1958 | Detrie et al. | 222/327 |
| 2,943,768 | 7/1960 | Lindsay | 222/327 |
| 3,136,456 | 6/1964 | Sherbondy | 222/327 |
| 3,401,847 | 9/1968 | Downing | 222/327 |
| 3,568,892 | 3/1971 | Burk | 222/327 |
| 3,880.331 | 4/1975 | Perkins | 222/327 |
| 3,910,466 | 10/1975 | Collar | 222/327 |
| 3,983,947 | 10/1976 | Wills | 222/327 X |
| 4,171,072 | 10/1979 | Davis | 222/391 X |
| 4,273,270 | 1/1981 | Krey | 222/327 |
| 4,376,498 | 3/1983 | Davis, Jr. | 222/326 |
| 4,570,832 | 2/1986 | Kroger | 222/389 X |
| 4,669,636 | 1/1987 | Miyata | 222/153 |
| 4,986,444 | 1/1991 | Corso | 222/327 |
| 4,986,454 | 1/1991 | Riley | 222/327 |
| 5,046,642 | 9/1991 | Cathcart, Sr. et al. | 222/326 |
| 5,054,655 | 10/1991 | Keller | 222/327 |
| 5,064,098 | 11/1991 | Hutter et al. | 222/327 |

FOREIGN PATENT DOCUMENTS

| | | | |
|---|---|---|---|
| 1118729 | 2/1982 | Canada | 222/326 |
| 343003 | 11/1989 | European Pat. Off. | 222/326 |
| 3400726 | 7/1985 | Fed. Rep. of Germany | 222/326 |

*Primary Examiner*—Andres Kashnikow
*Assistant Examiner*—Lesley D. Morris

[57] ABSTRACT

A viscous-material dispensing gun is presented which has a front material receiving portion and a rear drive portion. The front of the gun is loaded with viscous material and snapped into place by means of a locking collar and pins. The front conical portion of the gun is attached by thumbscrews. A flat or conical shaped disc is then driven by spring power, air pressure, or electrical power. This front disc forces the viscous material out the tapered nozzle of the front of the gun. Safety mechanisms are provided to insure that the driving force for the plunger does not drive the plunger out of the mechanism when the front portion is removed. A number of front material receiving cylinders may accompany the rear drive unit to insure the continuous ability of the workman to apply caulk or other material during the job.

4 Claims, 6 Drawing Sheets

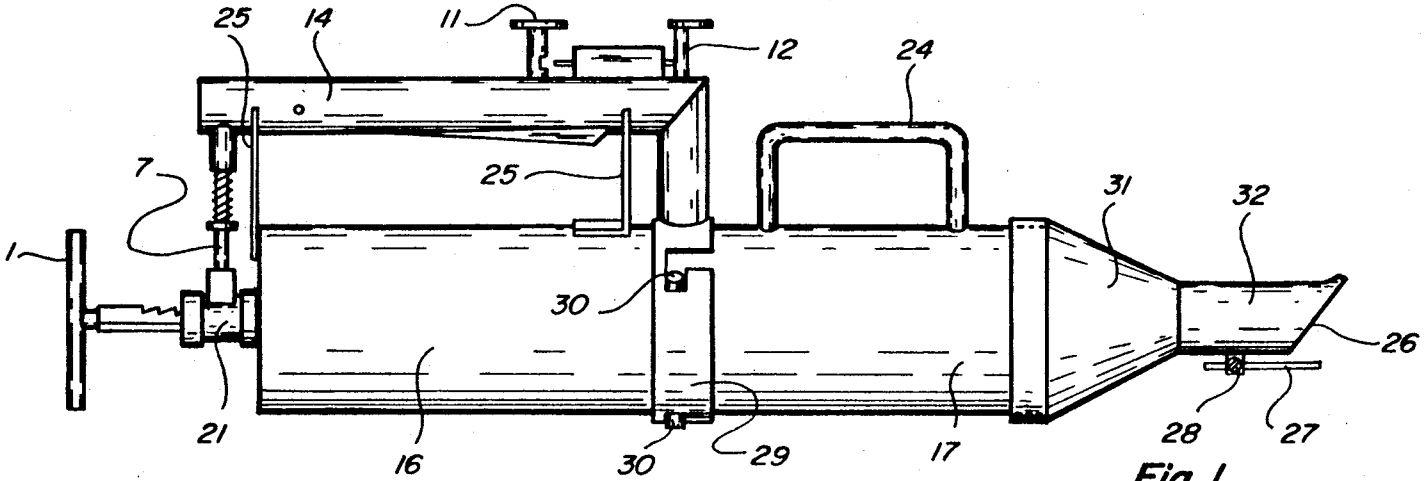
Fig. 1
Fig. 3
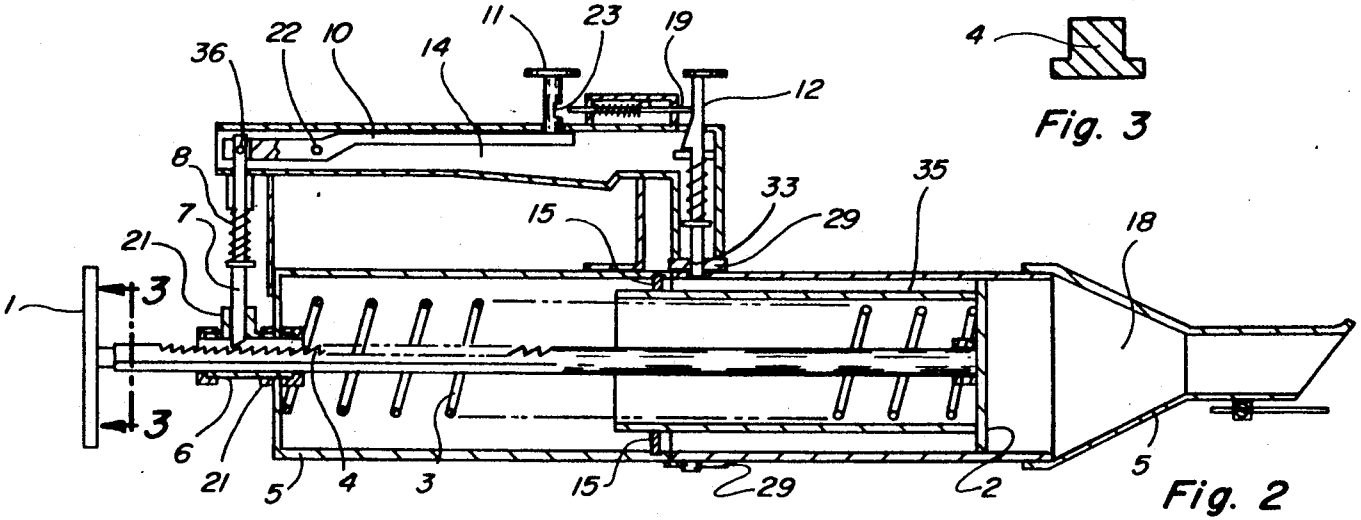
Fig. 2

AUTOMATIC TUCKPOINTING GUN

This application is a continuation-in-part of application Ser. No. 07/457,143, filed Dec. 26, 1989, now U.S. Pat. No. 5,046,642.

BACKGROUND OF THE INVENTION

This invention relates to the field involving the application of caulk, cement or mortar. More particularly, it relates to a new type of dispensing gun which utilizes direct introduction of the material to be dispensed into the gun. This application is a continuation-in-part of application Ser. No. 07/457,143, filed Dec. 26, 1989, now U.S. Pat. No. 5,046,642.

In the caulking or tuckpointing trade, the common method of dispensing the caulk or other material is to position a prepackaged tube of material into a caulking gun. The caulking gun then forces the material out the nozzle of the tube of caulk, thus dispensing the material. One problem frequently encountered in this dispensing operation is that the tube itself rotates. Rotating the tube changes the angle of declination of the point of the tube. It is highly desireable to keep the angle of declination of the point of the tube in a fixed position.

One method of keeping the angle of declination fixed is shown in the 1987 patent to Miyata, U.S. Pat. No. 4,669,636. In that invention it was a primary object to provide a dispensing gun which is capable of adjusting the orientation of the angled edge at the nozzle of the disposable cartridge for effectively applying a smooth bead. It is an object of this invention to provide a dispensing gun which has a constant angle at the dispensing tip of the device.

Another object of this invention is to provide a dispensing gun into which caulk or other material may be directly introduced without the need for pre-packaging. Dispensing guns for dispensing viscous materials generally utilize a cartridge-type of system wherein the cartridge is prepackaged and sold in discreet amounts. While the cartridge system has certain advantages, it has substantial disadvantages in the commercial application. For example, the cartridges which are sold in discreet amounts are often quite expensive with respect, to the job required. Additionally, the cartridge itself must be purchased in a set quantity and the packaging for the cartridge disposed of after use. Much waste ensues.

It is a further object of this invention to provide a dispensing gun for viscous materials which is reusable. It is also an object of this invention to provide a dispensing gun which may accept any amounts of viscous materials required by the particular job. It is a still further object of this invention to provide a dispensing gun with a number of individual front material receiving cylinders. Further and other objects of this invention will become apparent upon reading the following Specification.

BRIEF DESCRIPTION OF THE INVENTION

A spring-loaded, electric or air power, viscous-material dispensing gun is presented which has a front material receiving portion and a rear drive portion. The front of the gun is loaded with viscous material and snapped into place by means of a locking collar and pins. The front may be attached by a thumbscrew. A drive disc then forces the viscous material out the tapered nozzle of the front cone of the gun. Safety mechanisms are provided to insure that the spring-loaded drive device, or the air powered device, is locked in place when the front material receiving cylinder is removed. A number of front material receiving cylinders may accompany the rear drive unit so as to insure the continuous ability of the workman to apply caulk or other material during the job.

BRIEF DESCRIPTION OF THE DRAWINGS

FIG. 1 is a side view of the caulking gun.

FIG. 2 is a side cut-away view of the caulking gun showing the internal mechanisms.

FIG. 3 is a cut-away cross-sectional view of the drive shaft.

DETAILED DESCRIPTION OF THE PREFERRED EMBODIMENT

Figure 7:
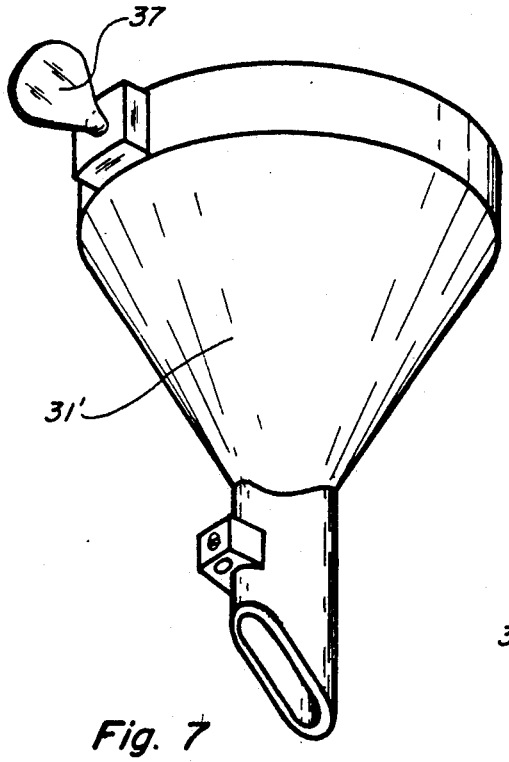
FIG. 7 is a perspective view of the front cone.
Figure 6:
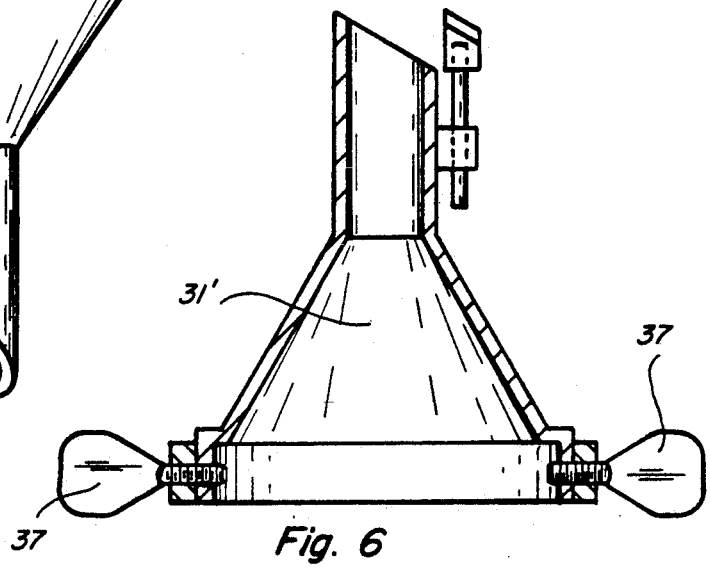
FIG. 6 is a side view of the front cone.

The instant device is composed of essentially two main parts, a rear drive mechanism cylinder 16 and a front dispensing cylinder 17. The front dispensing cylinder 17 is detachable from the rear cylinder by means of the locking collar 29 on the rear cylinder. The front dispensing cylinder 17 has a number of corresponding locking pins 30 which enable a workman to quickly lock the front and rear pieces together. As shown on FIG. 1, the front dispensing cylinder has an essentially circular cross section but the front part of the front cylinder has a conical shape 31. The front conical portion 31 tapers into a small cylindrical nozzle 32. The small cylindrical nozzle is tapered at its point as shown at 26. The front conical portion 31 may also be detached from the front dispensing cylinder 17. A removable front cone 31' is shown in FIGS. 6 and 7. This front cone 31' is removable by means of loosening the thumbscrew 37.

The internal mechanism of the spring-loaded device is best shown on FIG. 2. In this embodiment, the internal driving mechanism of the device comprises a plunger handle 1. This handle 1 is connected to the drive disc 2 by means of a notched drive shaft 4. The drive disc has an inner stabilizing tube 35 attached in back of the disc.

The preferred embodiment drive means is a large helical drive spring 3. Although the particular size of the entire device may vary, the preferred length of the drive spring is approximately twenty-two inches with an outside diameter of two and seven-eights ($2\frac{7}{8}$) inches. A spring of this size will produce approximately twenty pounds of pressure on the drive disc 2. Although the device will function with between five and thirty pounds of pressure on the main drive spring, it has been found that the twenty-two inch spring described above produces the best results. The preferred drive spring will compress to approximately ten inches in length. The rear cylinder is ideally ten inches in length while the front cylinder is about eight inches. The inner stabilizing tube 35 is about eight inches in the preferred embodiment.

Both the front and rear cylinders are essentially cylindrical in nature. The front and rear cylinders may be made of hard plastic or of any other convenient type of metal, for example, aluminum, light-weight steel, or similar material. The outer walls 5 of the front 17 and rear 16 cylinders are arranged so that they lock together by means of a rear cylinder locking collar 29 and front cylinder locking pins 30.

The rear portion of the rear cylinder has a drive shaft aperture casing 21. The notched drive shaft 4 has a cross-section as best shown on FIG. 3. This notched drive shaft protrudes out of the aperture so that the handle 1 is available to cock the mechanism. The drive shaft is notched along the rear half of its length furthest from the drive disc. On the bottom of the drive shaft in the drive shaft aperture casing is a bushing 6.

Turning now to the trigger mechanism, a drive shaft releasing plunger 7 is spring-operated to control the movement of the drive shaft 4 and hence the drive disc 2. The lower portion of the drive shaft releasing plunger is tapered so as to compliment the notches on the drive shaft 4. The drive shaft releasing plunger 7 is biased downwardly by the drive shaft releasing plunger spring 8. The drive shaft releasing plunger thus normally operates to prohibit the drive shaft from driving the drive disc forward and extruding material out the front nozzle. However, when the workman pushes the notched trigger 11 downward, the pivotable trigger lever 10 pivots about the trigger lever pivot point 22. The trigger lever 10 is pivotably connected to the releasing plunger 7 by a pivot pin 36. This action in turn, raises the drive shaft releasing plunger and allows the drive shaft to push the drive disc forward, thus discharging viscous material out the front nozzle.

Figure 4:
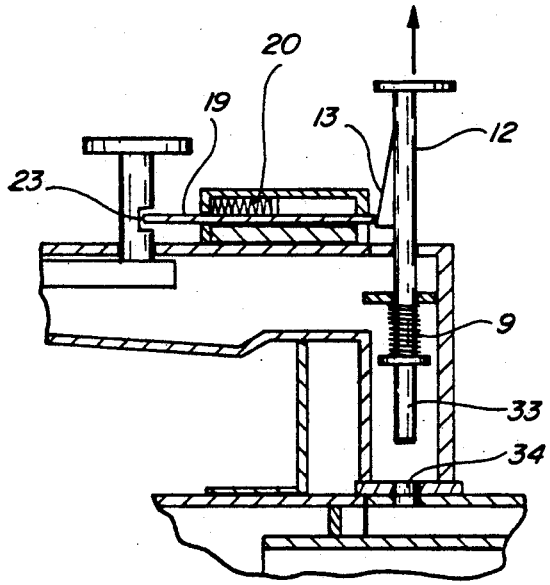
FIG. 4 is a detailed cut-away view of the trigger and safety pin mechanism.
Figure 5:
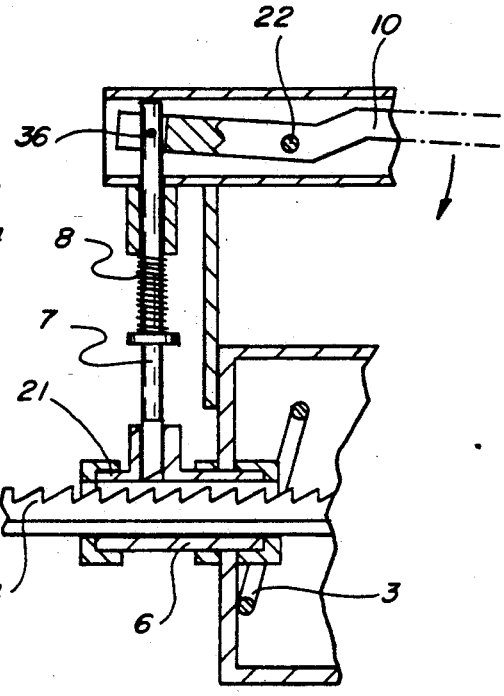
FIG. 5 is a detailed cross-sectional view showing the drive shaft releasing plunger.

When the front and rear cylindrical portions are disconnected for recharging the viscous material, a danger arises in that this action could allow the main drive spring and drive shaft to move rapidly forward in an unexpected motion. To avoid this problem, a safety mechanism has been provided. As best shown on FIG. 4, this safety mechanism comprises a safety pin 12 which moves in a vertical direction. The safety pin 12 has a tapered wedge 13 attached to its side as shown on FIG. 4. The safety pin 12 is biased downwardly by the safety pin spring 9. The lower portion 33 of the safety pin normally protrudes through both the front and rear outer casings 16 and 17 at casing hole 34. This locks the front and rear cylinders together. The locking collar 29 also helps secure the front and rear cylinder. The cylinders cannot rotate relative to each other with safety pin 12 in the down position. With the safety pin in the normally down position, as shown on FIG. 2, the tapered wedge 13 normally allows the sliding safety lock pin 19 to be biased away from the trigger locking notch 23, as shown on FIG. 2. However, when the safety pin is moved upwardly, the sliding safety lock pin 19 is forced to the left, against its spring bias, by the tapered wedge 13. Forcing the safety lock pin to the left into the trigger locking notch 23 locks the trigger in an "up" position. This, in turn, locks the drive shaft releasing plunger in a down position, locking the drive shaft 4. The combination of the trigger mechanism and safety lock pin mechanism will prevent the accidental disengagement of the mechanism and prevent the powerful drive spring from driving the drive shaft and disc in an outward direction with the front cylinder removed. The entire trigger and safety pin locking mechanism is located in a hollow rear upper handle 14.

To insure that the viscous material remains in the front cylinder and does not seep into the mechanism contained in the rear cylinder, and to stabilize the drive shaft as it moves forward, a protective O-ring 15 is located near the junction of the front and rear cylinder. This O-ring provides a seal between the disc and the outer portion of the front cylinder. The inner stabilizing tube 35 is in sealed contact with the O-ring 15. As the drive shaft 4 moves forward toward the nozzle, the stabilizing tube 35 remains in sealed contact with the O-ring. This not only seals out the viscous material from the drive spring, but also provides stability to the drive shaft 4.

Figure 8:
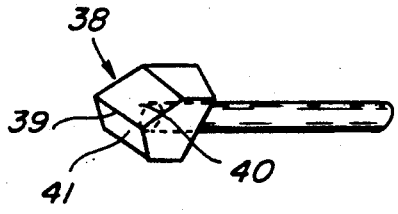
FIG. 8 is a detail perspective view of the guide.

The front dispensing cylinder has a front conical nozzle 18. The front cylinder 17 also has an upper front handle 24 shown on FIG. 1. Supporting struts 25 connect the hollow rear upper handle 14 to the main body of the rear driving mechanism 16. Near the tapered nozzle point 26 is an adjustable guide shaft 27. This adjustable guide shaft 27 allows the workman to position the mechanism in the appropriate position. The guide shaft 27 may be extended by loosening the guide shaft pin 28 and adjusting the length of the guide shaft. The guide shaft 27 may be simply a straight cylindrical guide shaft as shown on FIGS. 1 and 2 or it may have a specially shaped head, as shown on FIG. 8. This specially shaped head 38 is used especially in corners. The edge of the guide head 39 has oblique faces 40 and 41. The edge rides in the very corner of the joint while each face 40 and 41 rides on the corresponding side on the joint. The faces 40 and 41 are normally slightly wider than the joint itself so that the surfaces 40 and 41 actually slide across the surface of the brick or other material being sealed. This guide head 38 is normally positioned so that the edge 39 of the guide head is lined up with the same angle of the tapered nozzle point 26. As shown on FIG. 6, the guide head 38 is slidable within the guide shaft collar by adjusting the shaft pin 28. In normal operation, this guide head would be moved down (from the position shown in FIG. 6) so that the edge of the guide head and the tapered nozzle are in the same plane.

In operation, the front dispensing cylinder 17 is filled with viscous material, which could be caulk, cement, or any other type of viscous material. The plunger handle 1 is then pulled out, thus compressing the drive spring 3 and moving the drive disc towards the rear of the rear cylinder. The front dispensing cylinder 17 is then locked onto the rear drive mechanism cylinder 16 by means of the locking collar and pins and safety pin As the trigger 11 is pushed down, the drive shaft releasing plunger releases discreet amounts of material by pushing the drive disc forward. The forward motion of the drive disc forces the material out the front tapered end 26.

Figure 9:
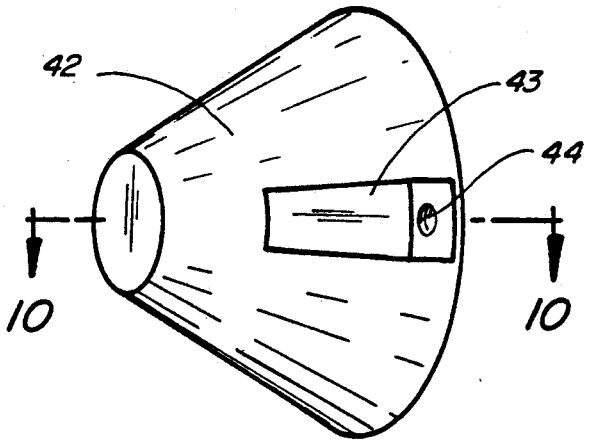
FIG. 9 is a perspective view of the conical plunger.
Figure 10:
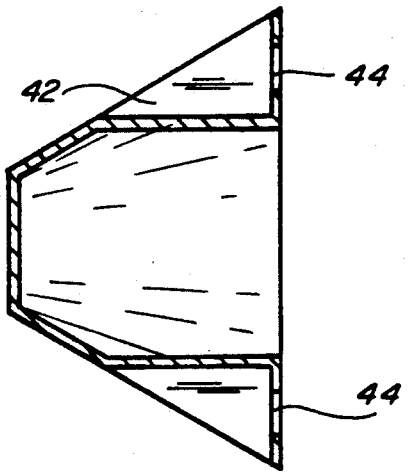
FIG. 10 is a cut-away view of the conical plunger.

In order to maintain maximum efficiency, an alternate plunger assembly system is provided. As best shown in FIGS. 9 and 10, this plunger 42 is made of rubber or aluminum or plastic and is designed to have approximately the same shape as the front cone 18. The front drive disc 2, shown on FIG. 2, is replaced by the conical plunger 42 shown on FIG. 9. This conical plunger 42 is attached to the front driving mechanism by means of the slots 43 and attaching holes 44. Screws are inserted through the holes 44 (one slot and hole on each side of the plunger cone 42) and are then fastened to the front disc 2 or other parallel surface. This front disc 2 or other parallel surface is attached to the drive shaft 4. The front plunger cone 42 has a reinforced cross-section as shown on FIG. 10. The attaching holes 44 and general shape of the truncated plunger cone as shown in FIGS. 9 and 10 enable a workman to push all or nearly all of the mortar out of the front nozzle portion 18 and apply it to the joint as desired.

Figure 11:
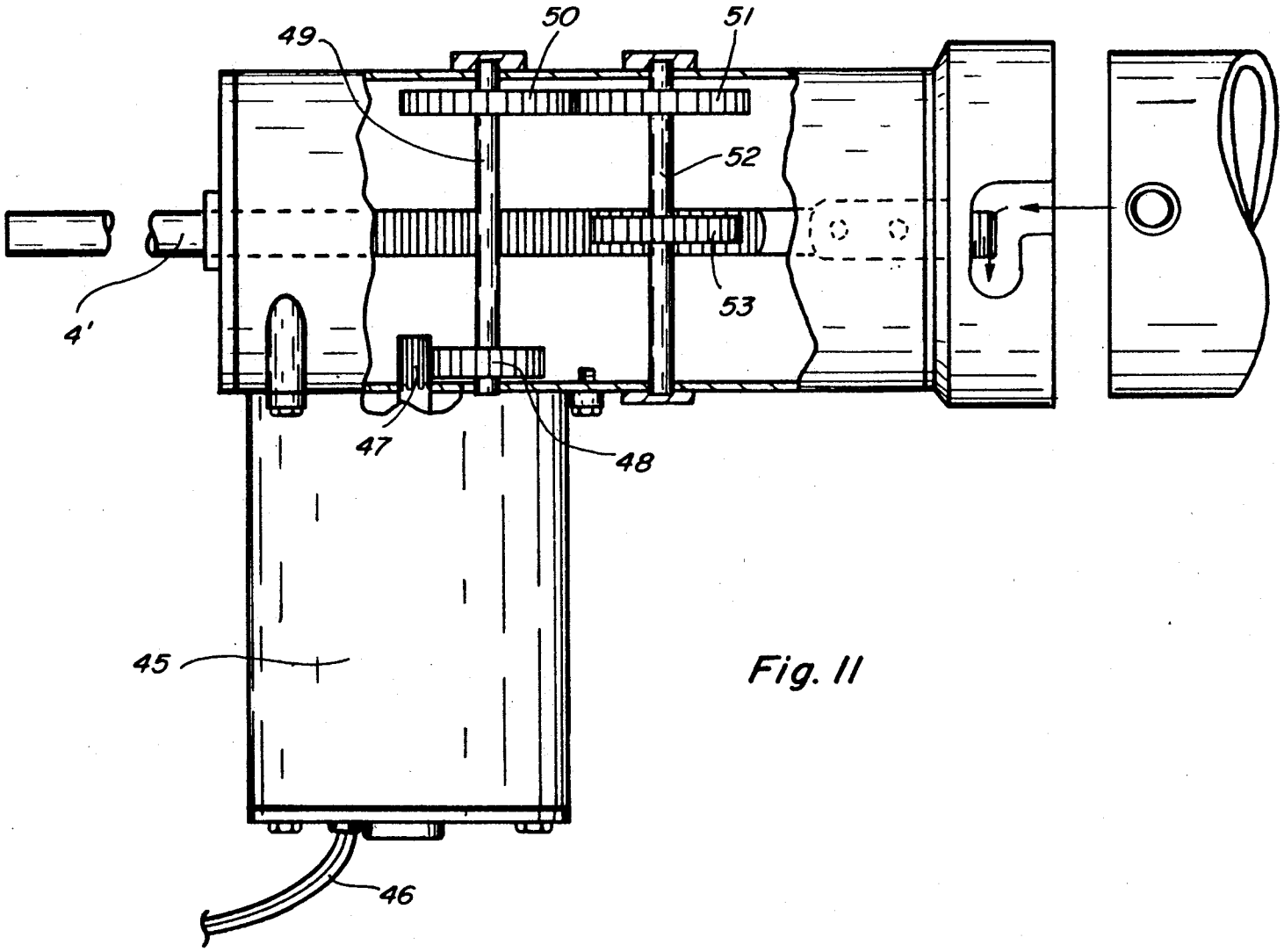
FIG. 11 is a side, partial cut-away view of the electric powered gun similar to FIG. 2.

The automatic tuckpointing gun may also be driven by means of electric power or air pressure. The spring mechanism and notched shaft of the spring-powered gun are replaced by an electric motor and a series of gears, as best shown on FIG. 11. A reversible electric motor 45 is attached to the bottom of the gun as shown. The reversible electric motor is attached to a means of electromotive power by the power cord 46. The electric motor has a main drive shaft 47 connected to a main drive shaft gear 48. This main drive shaft 47 turns in either a clockwise or counter-clockwise direction and is thus reversible. This main drive shaft gear turns a second drive shaft 49 which turns another gear 50. The gear 50 turns a gear 51 which turns shaft 52 which provides the force to the working gear 53. This working gear 53 is in contact with the main drive shaft 4'. In this application, the main drive shaft 4' is not notched as shown in FIG. 2 but is threaded to engage the working gear 53. As the motor is turned in one direction, the system of gears provides force to the working gear 53 which pushes the threaded drive shaft 4' and hence the plunger 42 forward. The gun may be reloaded when emptied by reversing the direction of the electric motor and withdrawing the threaded drive shaft 4' and plunger 42 from the front portion 17 of the caulking gun. Since the electric motor may be reversed or turned off, the safety mechanisms 7 and 12 shown in FIG. 2 is unnecessary.

Figure 12:
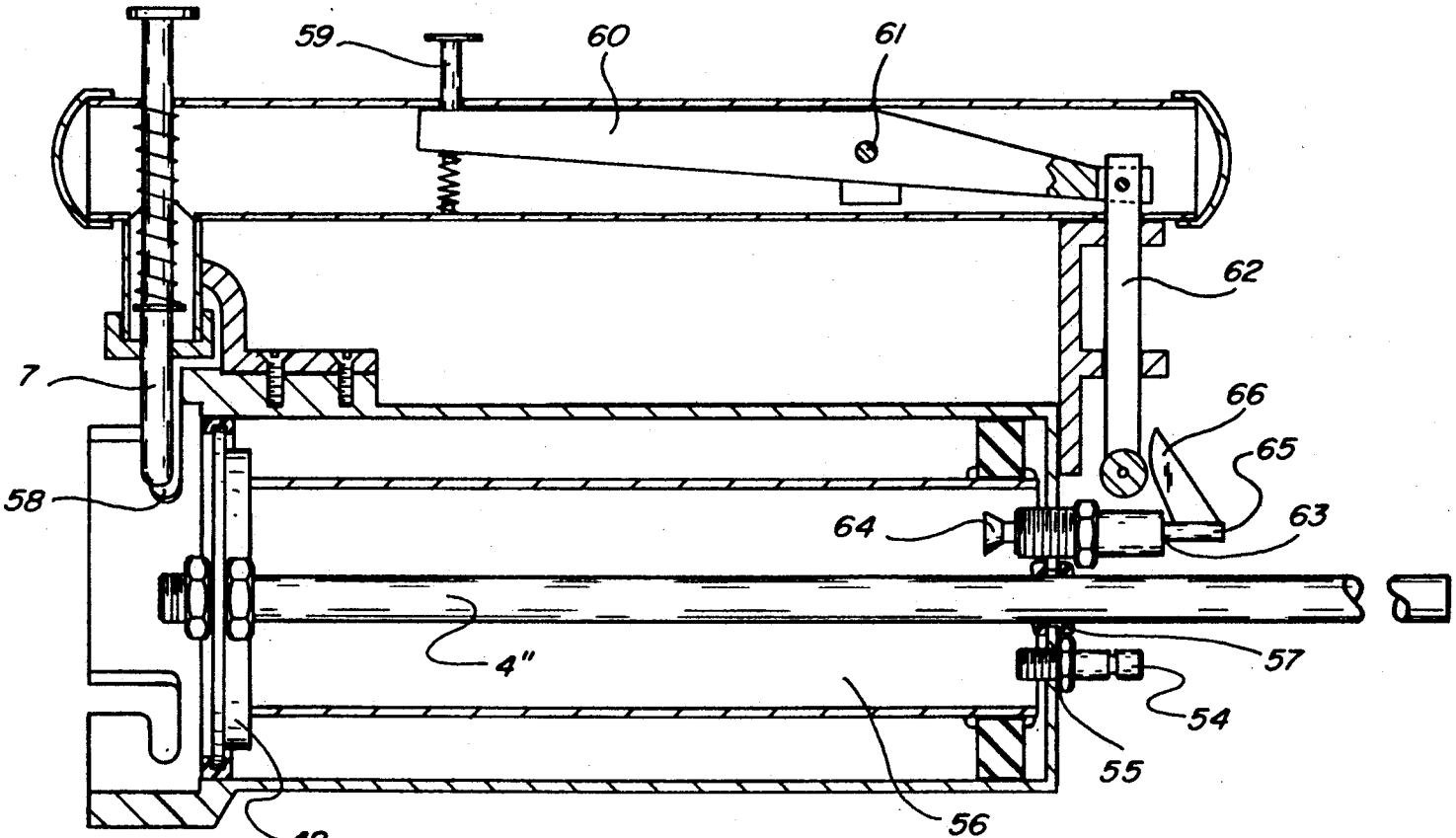
FIG. 12 is a partial side cut-away view of the air powered gun.
Figure 13:
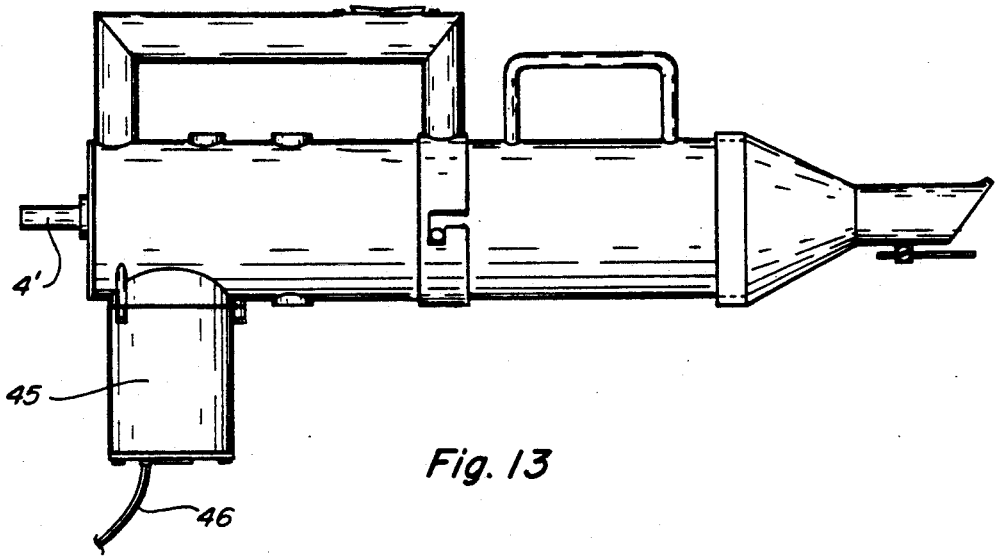
FIG. 13 is a side view of the caulking gun showing the electric-powered embodiment.
Figure 14:
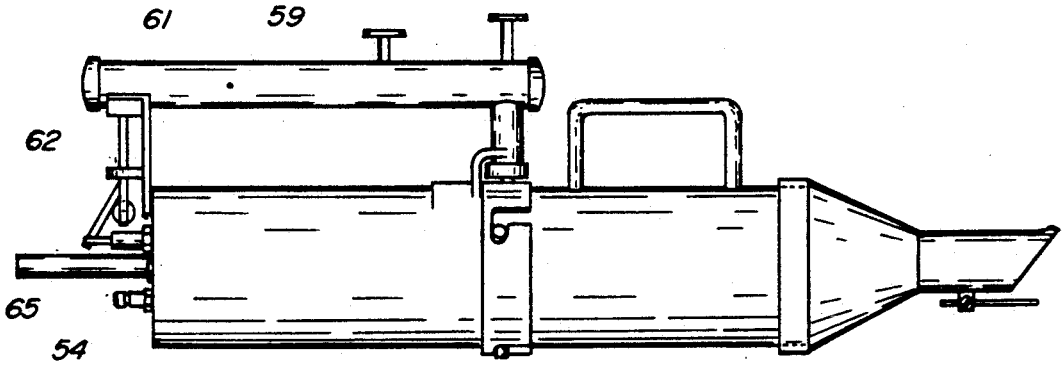
FIG. 14 is a side view of the caulking gun showing the air-powered embodiment.

FIG. 12 shows the embodiment of the caulking gun utilizing air pressure. In this embodiment, air pressure is provided by means of the air hook-up inlet 54. An air pressure hose is attached to the air inlet 54 which is sealed by means of an O-ring 55. The air pressure is then fed into an open chamber 56 which replaces the spring or gear mechanism of the spring driven or electrically driven guns illustrated in FIGS. 2 and 11.

A smooth shaft 4" is provided to drive the plunger 42. This smooth shaft has an O-ring seal 57 located at the rear of the chamber. (FIG. 12 shows the front of the gun to the left of the drawing.) The truncated conical plunger 42 is sealed by a similar O-ring which keeps a tight seal between the plunger and the inner surface of the cylinders 16 and 17. (The conical plunger 42 may also be replaced by the flat disc plunger 2 as shown in FIG. 2.) With either the flat disc plunger 2 or the conical plunger 42, the drive shaft releasing plunger 7 (as shown in FIG. 2) is used to keep the conical plunger or disc plunger from being driven by the air pressure when the front of the gun 17 is removed. This drive shaft releasing plunger 7 operates with the various safety catches shown and described in FIG. 2 with respect to the spring driven mechanism.

The drive shaft releasing plunger 7 is biased downwardly so that the disc plunger 2 or conical plunger 42 will not be forced out of the mechanism by the air pressure (when the front half to the gun 17 is removed). (In FIG. 12, the plunger moves from right to left in that drawing figure only.) This safety mechanism differs slightly from the mechanism shown in FIGS. 1 and 2 in that it is an independent safety catch. The drive shaft releasing plunger 7 becomes a safety releasing plunger as shown in FIG. 12. It is designed to be biased downward into the releasing plunger cut-out 58 for the disc or the cut-out 43 shown on the conical plunger 42 in FIG. 9. A trigger 59, normally biased upwards, moves a trigger arm 60 about a pivot point 61 to lift the air plunger arm 62 to close the air escape hole 63 in the upper handle 14. Pushing down on the trigger mechanism 59 raises the air release plunger arm 62 which in turn moves the air pressure sealing plunger 64. The air pressure sealing plunger 64 rides on a shaft 65 which has an upper oblique arm 66 and is normally biased open. Downward pressure on the trigger 59 raises the air release plunger arm 62 which in turn acts on the oblique arm 66 to move the air sealing plunger 64 from left to right thus sealing the air hole 63. When the air hole 63 is sealed by this motion, the open chamber 56 becomes pressurized and drives the smooth sealed shaft 4" from right to left thus pushing the disc plunger 2 or conical plunger 42 from right to left and pushing the mortar out through the conical nozzle 18 and front shaft 32.

It is within the contemplation of this invention that a number of front dispensing cylinders of similar shape and design may be used with a single rear drive mechanism cylinder. These front dispensing cylinders may each be loaded with material and supported on a rack in a vertical position. As the workman completes his job with a first front dispensing cylinder, a second dispensing cylinder may be readily attached by the previously disclosed method. Having a number of front dispensing cylinders available to the workman will greatly speed up the downtime for use of the mechanism.

This mechanism is ideally used for concrete mortar or grout and would save the workman much time and money by practicing this invention. The gun is ideally made of plastic or magnesium-aluminum alloy or a similar material. However, the gun could easily be made smaller for use in ceramic or mosaic tile applications. A funnel and scoop can be used to load the mortar into the gun should a number of front dispensing cylinders not be available. In the preferred embodiment, three to five front dispensing cylinders per gun are required.

Having fully described my invention, I claim:

1. An automatic electric dispensing gun for cement or other viscous material comprising;

(a) at least one detachable front material receiving cylinder for receiving unpackaged viscous material having a front conical section and a tapered dispensing nozzle, further comprising an adjustable guide shaft located said near said nozzle and having a rear cylindrical section wherein a plurality of locking pins are located;

(b) a rear drive mechanism cylinder detachably connected to said front cylinder by means of a front locking collar corresponding to said locking pins, said rear drive mechanism cylinder comprising a reversible electrical motor having a main drive shaft capable of turning in either a clockwise or counterclockwise direction, and a series of gears which drive a threaded shaft;

(c) a trigger means to drive the main shaft of said electric motor and said clockwise are in said counterclockwise direction;

wherein said front conical section is detachable by means of thumbscrews.

2. An automatic electric dispensing gun for cement or other viscous material as in cliam 1, further comprising a truncated cone plunger attached to the front of said threaded shaft for forcing said viscous material out of said nozzle.

3. An automatic electric dispensing gun for cement or other viscous material as in claim 1, further comprising an adjustable guide shaft with a tapered head wherein said tapered head has an edge and two oblique sides.

4. An automatic air pressure driven dispensing gun for cement or other viscous material, comprising:

(a) at leas one detachable front material receiving cylinder for receiving unpackaged viscous material having a front conical section and a tapered dispensing nozzle and having a rear cylindrical section wherein a plurality of locking pins are located;

(b) a rear drive mechanism cylinder detachable connected to said front cylinder by means of a front locking collar corresponding to said locking pins, comprising a smooth, sealed main drive shaft inside an air pressure chamber connected to a truncated conical viscous material plunger having safety slots cut on opposite sides thereof to receive a vertical releasing shaft, a source of air pressure, and a means to accumulate or release said air pressure;

(c) a trigger means comprising an air chamber plunger which alternately seals and opens said air pressure chamber to accumulate or release air pressure, respectively; and (d) a safety means comprising a vertical releasing shaft biased downwardly;

whereby said viscous plunger is prohibited from being driven out of the mechanism by said air pressure when the front and rear sections are disconnected.

* * * * *